US011768450B2

(12) United States Patent
Kishi et al.

(10) Patent No.: US 11,768,450 B2
(45) Date of Patent: Sep. 26, 2023

(54) DRUM MEMBER AND IMAGE FORMING APPARATUS

(71) Applicant: FUJIFILM Business Innovation Corp., Tokyo (JP)

(72) Inventors: Kazuki Kishi, Ebina (JP); Koichiro Yuasa, Ebina (JP); Kazuyoshi Hagiwara, Ebina (JP); Kei Tanaka, Ebina (JP); Tomoaki Yoshioka, Ebina (JP); Toshiaki Baba, Ebina (JP); Yoko Miyamoto, Ebina (JP); Hirotaka Tanaka, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/871,563

(22) Filed: Jul. 22, 2022

(65) Prior Publication Data

US 2022/0357691 A1 Nov. 10, 2022

Related U.S. Application Data

(63) Continuation of application No. PCT/JP2020/031831, filed on Aug. 24, 2020.

(30) Foreign Application Priority Data

Mar. 5, 2020 (JP) ..... 2020-038158

(51) Int. Cl.
*G03G 15/20* (2006.01)
*G03G 15/16* (2006.01)

(52) U.S. Cl.
CPC ..... *G03G 15/1615* (2013.01)

(58) Field of Classification Search
CPC ..... G03G 15/1615; G03G 15/20
(Continued)

(56) References Cited

U.S. PATENT DOCUMENTS 5,809,889 A 9/1998 Holm
6,748,862 B2 6/2004 Frankenberger et al.
(Continued)

FOREIGN PATENT DOCUMENTS

DE 197 41 092 A1 3/1999
JP S58-022264 U 2/1983
(Continued)

OTHER PUBLICATIONS

Nov. 2, 2020 International Search Report issued in International Patent Application No. PCT/JP2020/031831.
(Continued)

*Primary Examiner* — Hoan H Tran
(74) *Attorney, Agent, or Firm* — Oliff PLC

(57) ABSTRACT

A drum member includes: a substantially cylindrical drum body having a hollow part extending in an axial direction; a sheet member wound on the drum body; an adjusting mechanism configured to adjust tension in the sheet member, the adjusting mechanism including a moving member that holds an end of the sheet member in a circumferential direction and moves in a depth direction of the hollow part, and a fixing member that fixes the moving member to the drum body; and one or more positioning members that position the moving member such that the moving member does not move in the circumferential direction of the drum body when the moving member is fixed with the fixing member.

20 Claims, 9 Drawing Sheets

(58) Field of Classification Search
USPC ..... 399/121, 313
See application file for complete search history.

(56) References Cited

U.S. PATENT DOCUMENTS

| | | | | |
|---|---|---|---|---|
| 7,599,653 | B2 * | 10/2009 | Asakura | G03G 15/161 430/124.21 |
| 8,311,456 | B2 * | 11/2012 | Murata | G03G 15/5008 399/167 |
| 2002/0023563 | A1 | 2/2002 | Frankenberger et al. | |
| 2005/0249530 | A1 | 11/2005 | McLean et al. | |
| 2014/0230673 | A1 | 8/2014 | Mor-Yosef et al. | |

FOREIGN PATENT DOCUMENTS

| | | | |
|---|---|---|---|
| JP | H09-507659 | A | 8/1997 |
| JP | 2002-067272 | A | 3/2002 |
| JP | 3093934 | U | 5/2003 |
| JP | 2007-112037 | A | 5/2007 |
| JP | 2007-536582 | A | 12/2007 |
| JP | 2011-150067 | A | 8/2011 |
| JP | 5820077 | B2 | 11/2015 |

OTHER PUBLICATIONS

Nov. 2, 2020 Written Opinion of the International Searching Authority issued in International Patent Application No. PCT/JP2020/031831.

* cited by examiner

DRUM MEMBER AND IMAGE FORMING APPARATUS

CROSS-REFERENCE TO RELATED APPLICATIONS

This is a continuation of International Application No. PCT/JP2020/031831 filed on Aug. 24, 2020, and claims priority from Japanese Patent Application No. 2020-038158 filed on Mar. 5, 2020.

BACKGROUND

(i) Technical Field

The present disclosure relates to a drum member and an image forming apparatus.

(ii) Related Art

Japanese Patent No. 5820077 discloses a blanket pulling device for an image-transfer-medium drum, the blanket pulling device having two long, narrow blanket holders. The blanket holders are disposed substantially parallel to each other, and at least one of the blanket holder can move toward or away from the other blanket holder.

SUMMARY

Aspects of non-limiting embodiments of the present disclosure relate to stabilizing the temporary fixing position of a sheet member with respect to a drum body when the sheet member is to be wound on and fixed to the drum body, compared with the case where the temporary fixing position of the sheet member with respect to the drum body is unfixed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a drum member including: a substantially cylindrical drum body having a hollow part extending in an axial direction; a sheet member wound on the drum body; an adjusting mechanism configured to adjust tension in the sheet member, the adjusting mechanism including a moving member that holds an end of the sheet member in a circumferential direction and moves in a depth direction of the hollow part, and a fixing member that fixes the moving member to the drum body; and one or more positioning members that position the moving member such that the moving member does not move in the circumferential direction of the drum body when the moving member is fixed with the fixing member.

BRIEF DESCRIPTION OF THE DRAWINGS

Exemplary embodiment of the present disclosure will be described in detail based on the following figures, wherein.

DETAILED DESCRIPTION

An exemplary embodiment of the present disclosure will be described in detail below with reference to the drawings. In the description below, the upstream side and the downstream side in the transport direction of a recording sheet P, which is an example of a recording medium, may be described simply as "the upstream side" and "the downstream side". Similarly, the upstream side and the downstream side in the rotation direction of a transfer drum 50, which is an example of a drum member, may be described simply as "the upstream side" and "the downstream side". The "side view" is a view of the transfer drum 50 as viewed in the axial direction.

Figure 1:
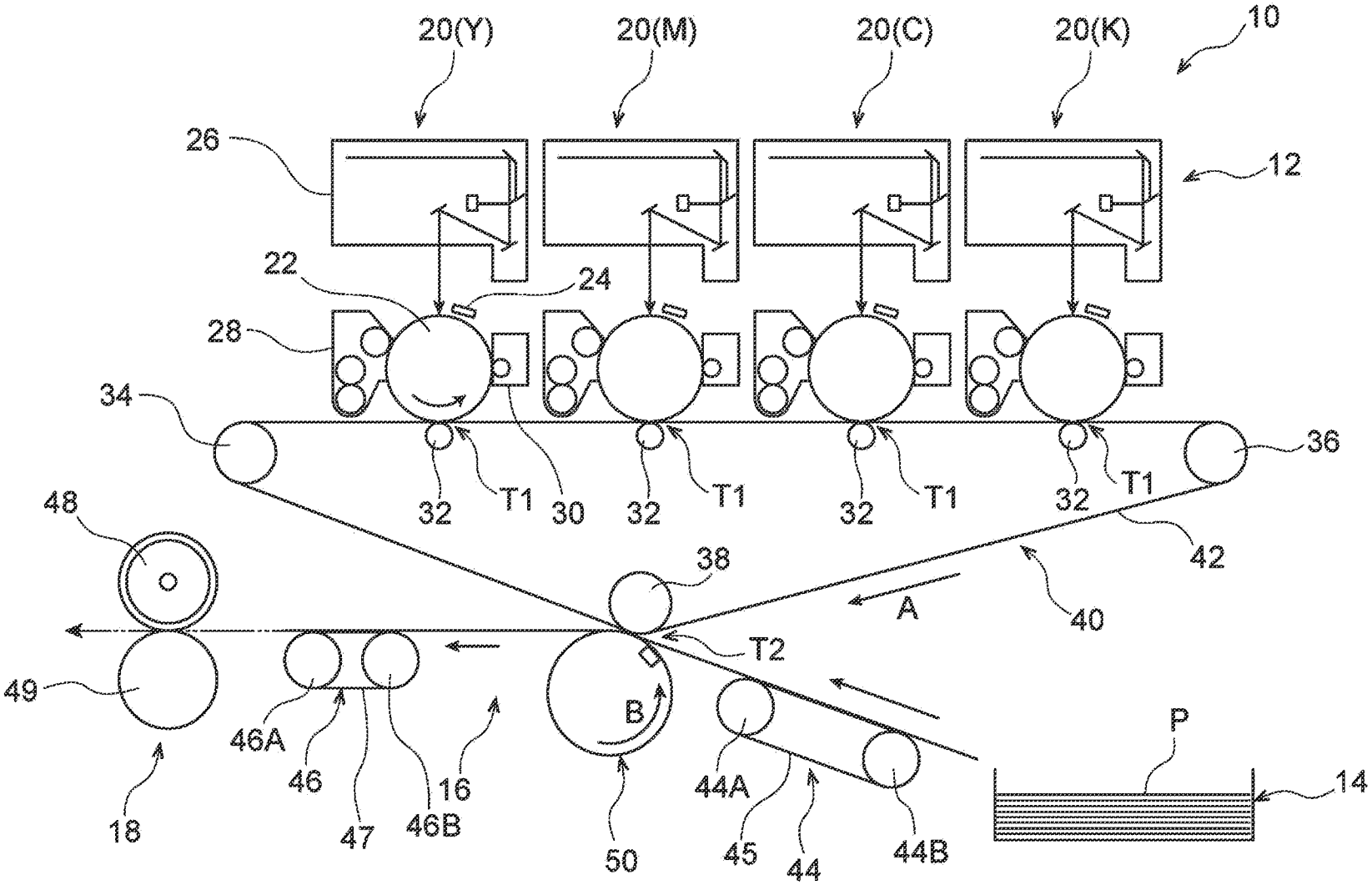
FIG. 1 schematically shows the configuration of an image forming apparatus according to an exemplary embodiment.

As shown in FIG. 1, an image forming apparatus 10 forms a toner image (an example of an image) on a recording sheet P with, for example, an electrophotographic system. The image forming apparatus 10 includes an image forming section 12, a storage unit 14, a transport unit 16, and a fixing device 18 in an apparatus body (not shown). These components (the image forming section 12, the transport unit 16, and the fixing device 18) of the image forming apparatus 10 will be described below.

Image Forming Section

The image forming section 12 forms a toner image on a recording sheet P. More specifically, the image forming section 12 includes toner-image forming units 20 and an intermediate transfer device 40.

Toner-Image Forming Unit

As shown in FIG. 1, there are multiple toner-image forming units 20 to form different color toner images. In this exemplary embodiment, there are four toner-image forming units 20Y, 20M, 20C, and 20K, which correspond to four colors, namely, yellow (Y), magenta (M), cyan (C), and black (K).

In the description below, letters Y, M, C, and K are affixed to the reference signs of the components when the colors (yellow (Y), magenta (M), cyan (C), and black (K)) need to be distinguished, and the letters Y, M, C, and K may be omitted when there is no need to distinguish the colors. Because the toner-image forming units 20 corresponding to the respective colors have the same structure, in FIG. 1, only the components related to the toner-image forming unit 20Y are denoted by reference signs.

Each toner-image forming unit 20 has a photoconductor drum 22 that rotates in one direction (for example, counter-clockwise in FIG. 1). The toner-image forming unit 20 also includes a charger 24, an exposure device 26, a developing device 28, and a removal device 30, in this order from the upstream side in the rotation direction of the photoconductor drum 22.

In the toner-image forming unit 20, the charger 24 charges the outer circumferential surface of the photoconductor drum 22. The exposure device 26 exposes, to the light, the outer circumferential surface of the photoconductor drum 22 charged by the charger 24 to form an electrostatic latent image thereon. The developing device 28 develops the electrostatic latent image formed on the outer circumferential surface of the photoconductor drum 22 by the exposure device 26 to form a toner image. Then, after the toner image is transferred to a transfer belt 42 (described below), the removal device 30 removes the residual toner on the outer circumferential surface of the photoconductor drum 22.

Intermediate Transfer Device

As shown in FIG. 1, the intermediate transfer device 40 includes first transfer rollers 32, which are an example of first transfer bodies, the transfer belt 42, which is an example of an intermediate transfer body, and a transfer drum 50, which is an example of a second transfer body. In the intermediate transfer device 40, the toner images formed on the outer circumferential surfaces of the photoconductor drums 22 corresponding to the respective colors are first-transferred to the transfer belt 42 in a superposed manner, and the superposed toner images are second-transferred to a recording sheet P. The transfer drum 50 will be described in detail below.

First Transfer Roller

As shown in FIG. 1, the first transfer rollers 32 transfer the toner images formed on the outer circumferential surfaces of the photoconductor drums 22 to the outer circumferential surface of the transfer belt 42 at first transfer positions T1 between the photoconductor drums 22 and the first transfer rollers 32. In this exemplary embodiment, a first transfer voltage is applied between the first transfer rollers 32 and the photoconductor drums 22 to transfer the toner images formed on the outer circumferential surfaces of the photoconductor drums 22 to the outer circumferential surface of the transfer belt 42 at the first transfer positions T1.

Transfer Belt

As shown in FIG. 1, the transfer belt 42 has a loop shape such that toner images are transferred to the outer circumferential surface thereof, and is stretched over a driving roller 34, a tension roller 36, and a backup roller 38 so as to be held in a certain orientation. The driving roller 34 is configured to be rotationally driven by a driving unit (not shown) to revolve the transfer belt 42 in the direction of arrow A at a predetermined speed.

The backup roller 38 is opposed to the transfer drum 50 with the transfer belt 42 therebetween. The contact area between the transfer drum 50 and the transfer belt 42, in other words, the area where the transfer drum 50 and the transfer belt 42 nip a recording sheet P, is a nip area Np (see FIG. 2). The nip area Np is a second transfer position T2, where a toner image is transferred from the transfer belt 42 to a recording sheet P.

Transport Unit

As shown in FIG. 1, the transport unit 16 includes a first transport unit 44 and a second transport unit 46. The first transport unit 44 is disposed upstream of the transfer drum 50 and transports a recording sheet P fed out of the storage unit 14 to the transfer drum 50. The second transport unit 46 is disposed downstream of the transfer drum 50 and transports, to the fixing device 18, the recording sheet P to which a toner image has been second-transferred while passing through the nip area Np (second transfer position T2).

The first transport unit 44 includes a driving roller 44A and a driven roller 44B separated in the sheet transport direction, and a transport belt 45 wound around the driving roller 44A and the driven roller 44B. The second transport unit 46 includes a driving roller 46A and a driven roller 46B separated in the sheet transport direction, and a transport belt 47 wound around the driving roller 46A and the driven roller 46B.

Fixing Device

As shown in FIG. 1, the fixing device 18 includes a heating roller 48, which is an example of a heating member, and a pressure roller 49, which is an example of a pressure member. In the fixing device 18, the heating roller 48 and the pressure roller 49 apply heat and pressure while nipping the recording sheet P therebetween to fix the toner image transferred to the recording sheet P by the transfer drum 50.

Intermediate Transfer Device

Transfer Drum

The transfer drum 50 in the thus-configured image forming apparatus 10 will be described in detail below.

Figure 2:
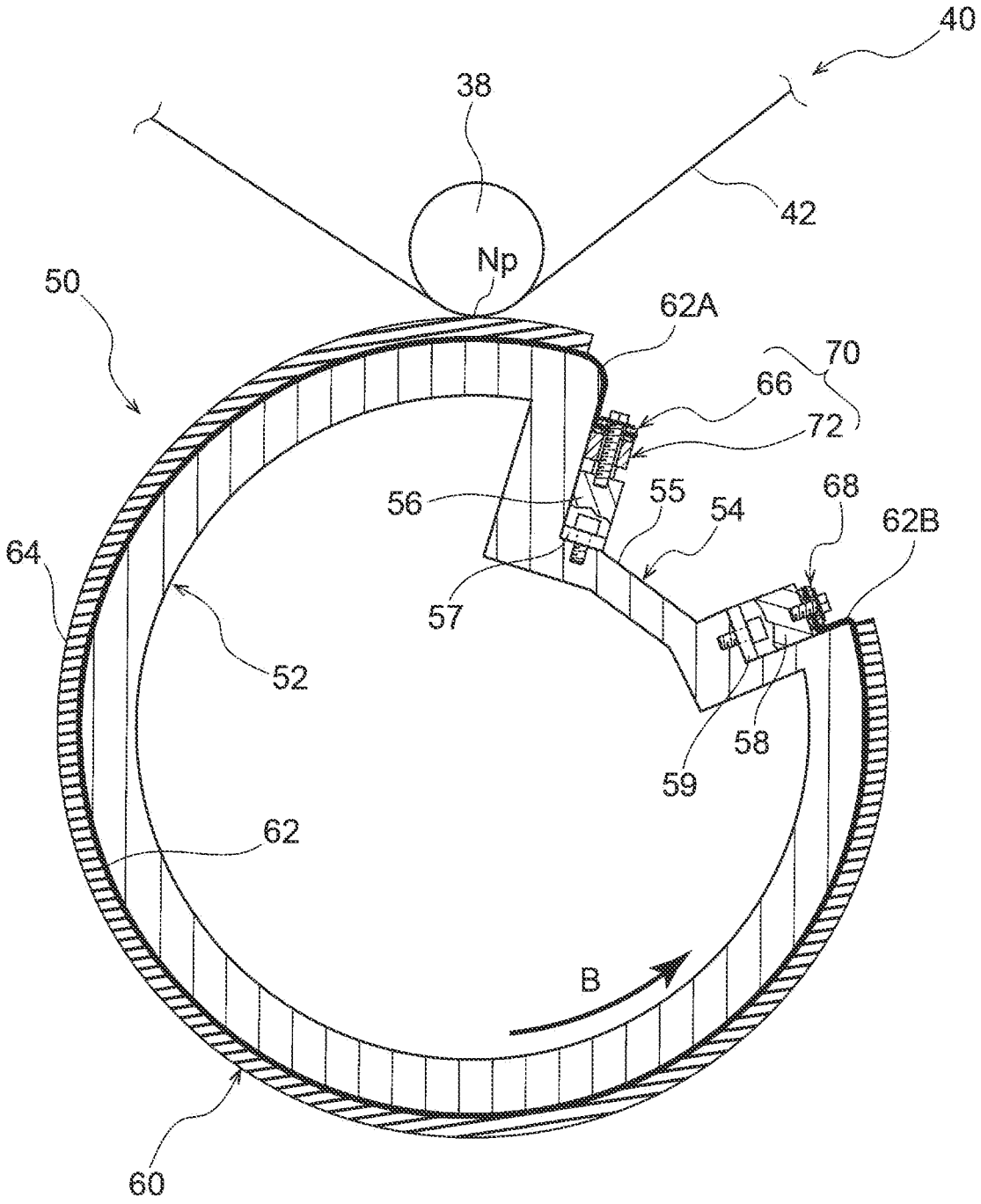
FIG. 2 is a side view of a transfer drum according to the exemplary embodiment.
Figure 3:
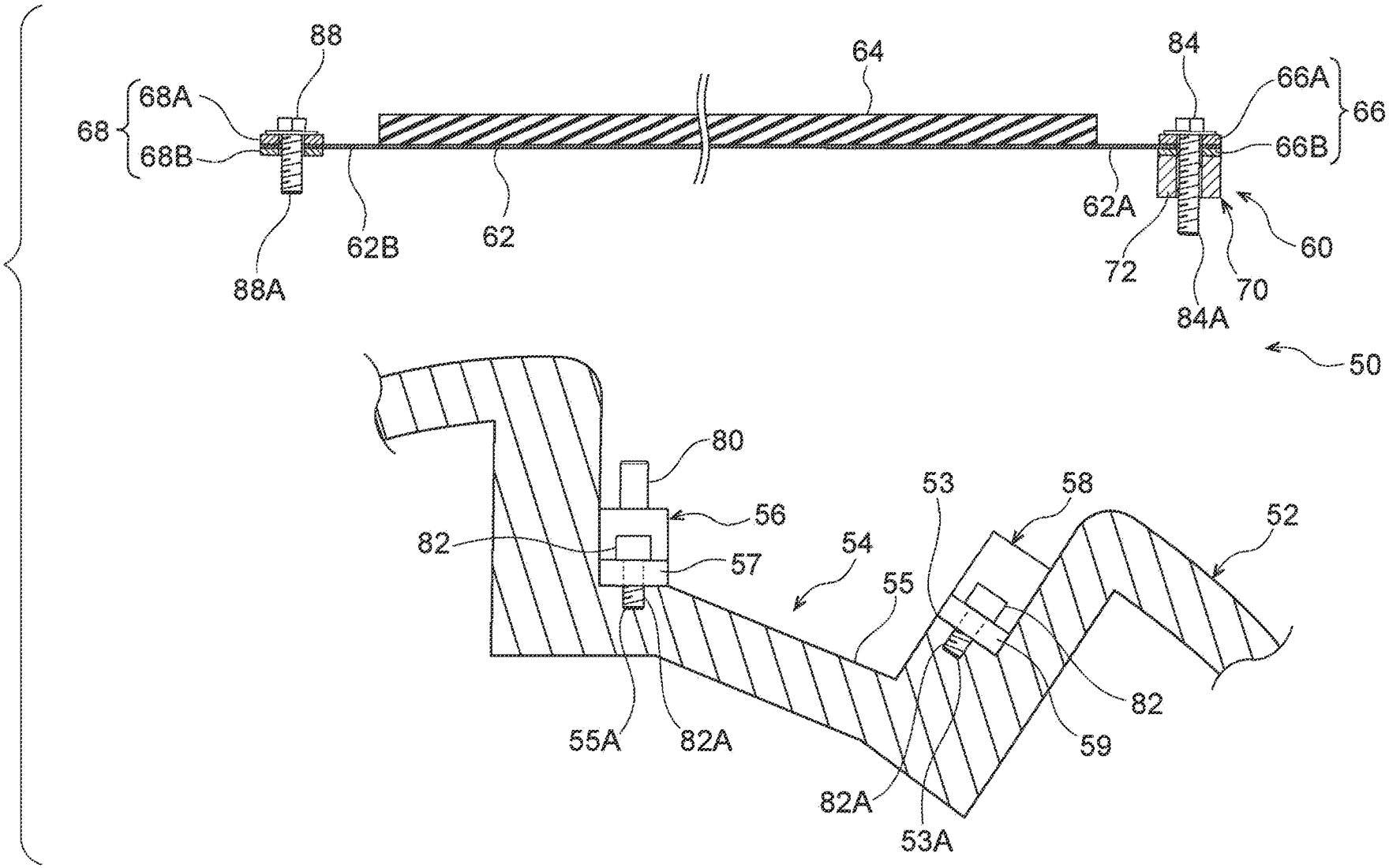
FIG. 3 is an enlarged side view of a transfer member before being attached to the transfer drum according to the exemplary embodiment.

As shown in FIGS. 2 and 3, the transfer drum 50 includes a transfer drum body 52, which is an example of a drum body, and a transfer member 60, which is an example of a sheet member wound on the transfer drum body 52. The transfer drum body 52 is substantially cylindrical and has a single recess 54, which is an example of a hollow part, extending in the axial direction, at a portion in the outer circumferential surface thereof. The transfer drum body 52 is made of a metal material, such as stainless steel, aluminum, or copper. In the description below, the depth direction of the recess 54 will be referred to as the "substantially radial direction".

A pair of sprockets (not shown) are disposed at the ends of the transfer drum body 52 in the axial direction. The transfer drum 50 (transfer drum body 52) rotates in one direction (the direction of arrow B shown in FIGS. 1 and 2) as a result of the sprockets being rotationally driven by a driving unit (not shown) via driving-force transmission members (not shown), such as chains. The recess 54 accommodates multiple grippers (not shown), which are arranged in the axial direction, for gripping the downstream end (the portion other than the area to which the toner image is to be transferred) of the recording sheet P delivered from the first transport unit 44.

With this configuration, the transfer drum 50 rotates and transports the recording sheet P to the contact portion with the transfer belt 42 while gripping the downstream end of the recording sheet P with the grippers. When a second transfer voltage is applied to the transfer drum 50 while a recording sheet P is nipped between the surface (surface layer 64, described below) of the transfer drum 50 and the outer circumferential surface of the transfer belt 42, the toner image is transferred from the transfer belt 42 to the recording sheet P at the second transfer position T2 (nip area Np).

Figure 4:
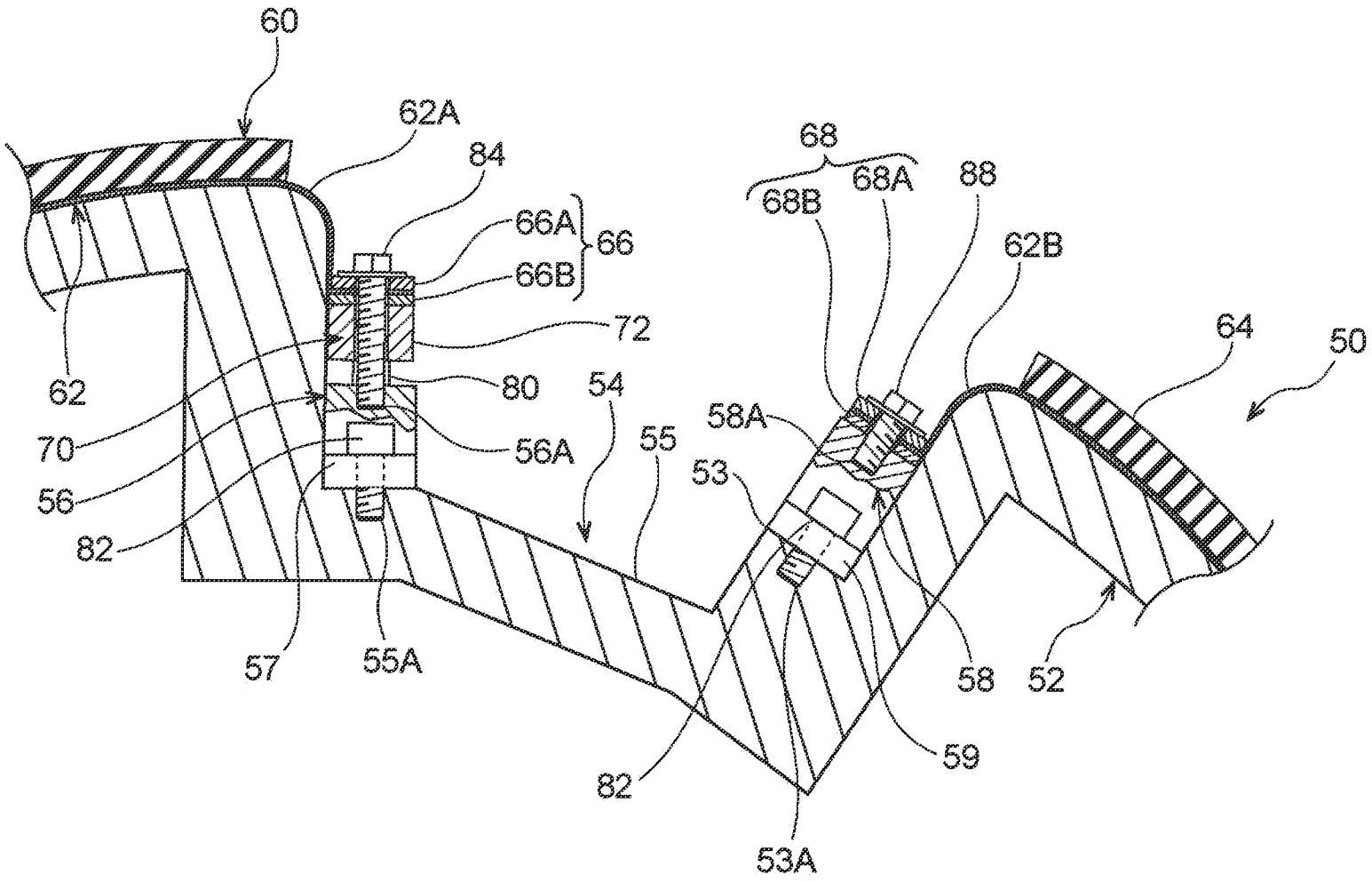
FIG. 4 is an enlarged side view of the transfer member after being attached to the transfer drum according to the exemplary embodiment.
Figure 5:
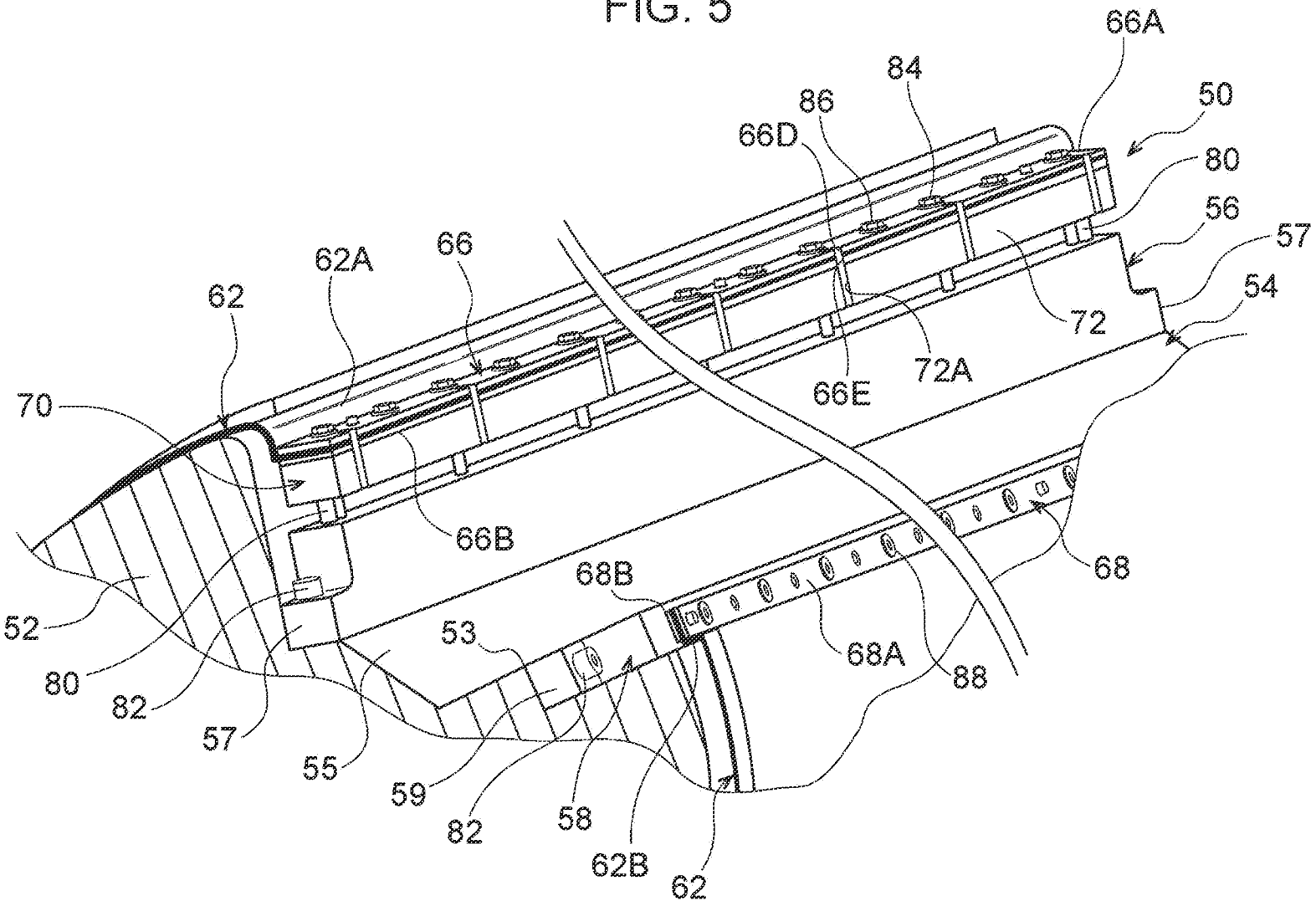
FIG. 5 is a perspective view showing the configuration of a recess in the transfer drum according to the exemplary embodiment.
Figure 6:
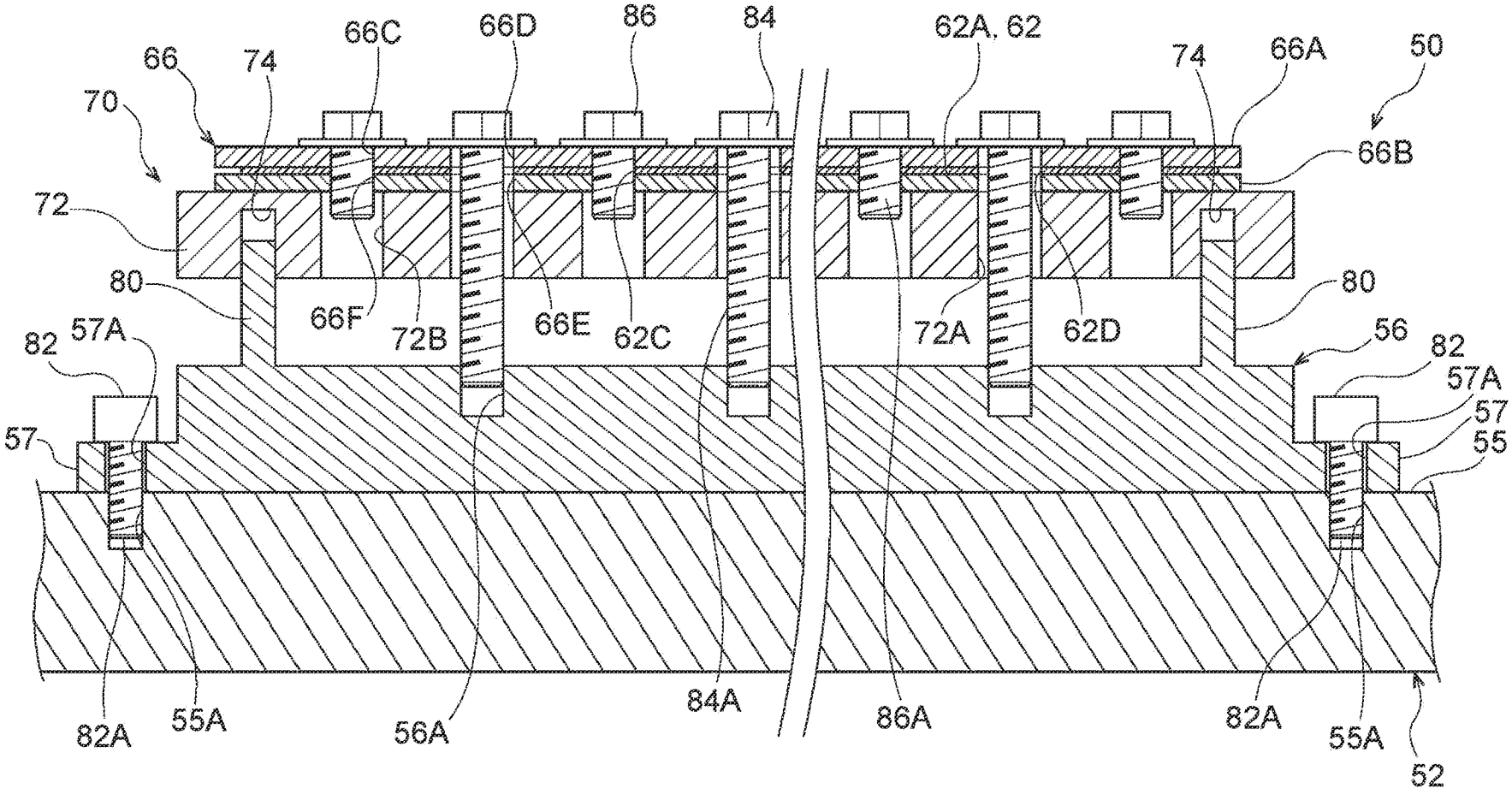
FIG. 6 is a sectional view showing the configuration of the recess in the transfer drum according to the exemplary embodiment, as viewed in the circumferential direction.
Figure 7:
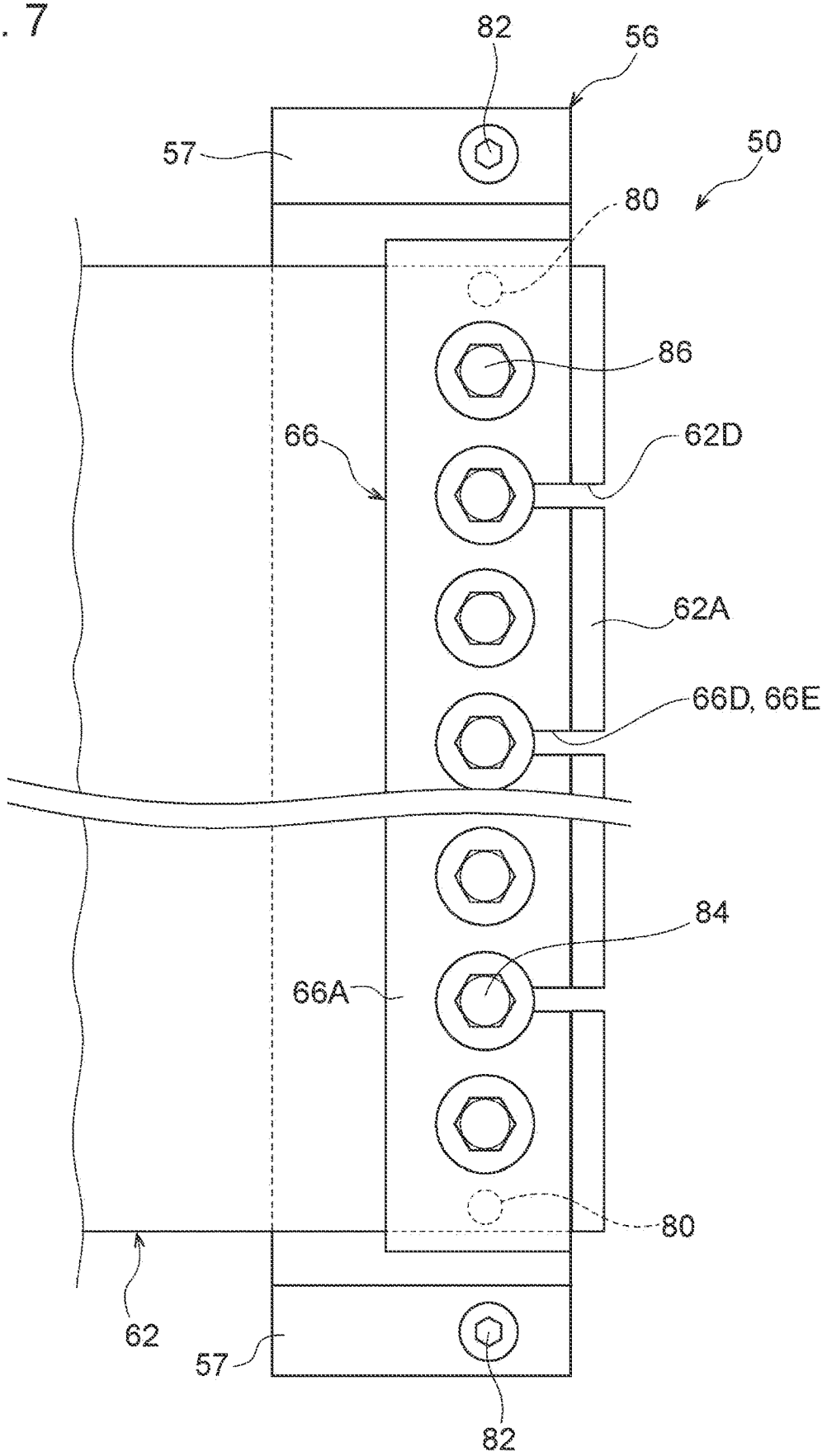
FIG. 7 is a plan view showing the configuration of the recess in the transfer drum according to the exemplary embodiment, as viewed in the radial direction.

As shown in FIGS. 2 to 4, a drum-side block 56, which is an example of a seating member, is provided at one side (upstream side), in the circumferential direction, of a bottom surface 55 of the recess 54 in the transfer drum body 52. As shown in FIGS. 5 to 7, the drum-side block 56 extends in the axial direction of the transfer drum body 52 and has a substantially rectangular parallelepiped shape such that the length in the substantially radial direction is larger than the length in the substantially circumferential direction. The drum-side block 56 has flanges 57 having a predetermined thickness and projecting axially outward at the lower ends of both side walls thereof in the axial direction.

As shown in FIG. 6, the flanges 57 have through-holes 57A for receiving bolts, and the bottom surface 55 has female screw portions 55A extending substantially in the radial direction at both ends thereof in the axial direction, on one side in the circumferential direction. Hence, as a result of the drum-side block 56 being disposed on one side of the bottom surface 55 in the circumferential direction such that the through-holes 57A and the female screw portions 55A are continuous with each other, and shafts 82A (male screw portions) of bolts 82 being inserted into the through-holes 57A and screwed into the female screw portions 55A, the drum-side block 56 is attached to one side of the bottom surface 55 in the circumferential direction.

Furthermore, as shown in FIGS. 3, 5, and 6, the drum-side block 56 has guide pins 80 projecting (extending) substantially radially outward at both ends thereof in the axial direction, except for the flanges 57. The guide pins 80 are cylindrical, and at least the distal end portions thereof are inserted into guide holes 74 provided in a block member 72 (described below) with a predetermined clearance (for example, a gap of about 1 mm in the radial direction of the guide pins 80).

The guide pins 80 and the guide holes 74 are an example of positioning members. The circumferential portions of the ends of the guide pins 80 may be tapered (not shown) at a predetermined angle so that the guide pins 80 can be easily inserted into the guide holes 74.

Furthermore, as shown in FIGS. 2 to 4, a step portion 53 projecting substantially radially outward further than the bottom surface 55 is provided in the recess 54 in the transfer drum body 52, on the other side (downstream side) of the bottom surface 55 in the circumferential direction. A drum-side block 58, which is an example of a seating member, is provided on the step portion 53.

As shown in FIG. 5, the drum-side block 58 also extends in the axial direction of the transfer drum body 52 and has a substantially rectangular parallelepiped shape such that the length in the substantially radial direction is larger than the length in the substantially circumferential direction. The drum-side block 58 has flanges 59 having a predetermined thickness and projecting axially outward at the lower ends of both side walls thereof in the axial direction.

The flanges 59 have through-holes (not shown) for receiving bolts, and the step portion 53 has female screw portions 53A (see FIGS. 3 and 4) extending substantially in the radial direction at both ends thereof in the axial direction. As a result of the drum-side block 58 being disposed on the step portion 53 such that the through-holes and the female screw portions 53A are continuous with each other, and shafts 82A (male screw portions) of bolts 82 being inserted through the through-holes and screwed into the female screw portions 53A, the drum-side block 58 is attached to the step portion 53.

As shown in FIGS. 2 to 4, the transfer member 60 includes a base layer 62, which is an example of an inner layer (metal layer), wound on the transfer drum body 52 without being bonded thereto, and a surface layer 64, which is an example of an outer layer (transfer layer), wound on and bonded to the outer circumferential surface of the base layer 62 (with a bonding layer (not shown) therebetween).

The base layer 62 is made of a metal material, such as stainless steel, aluminum, or copper. In this exemplary embodiment, the base layer 62 is made of stainless steel. The thickness of the base layer 62 is, for example, 0.1 mm. An example of the bonding layer (not shown) is acrylic conductive adhesive.

The surface layer 64 is made of, for example, a conductive resin material, such as: solid rubber including nitrile rubber, chloroprene rubber, ethylene-propylene-diene rubber, acrylonitrile-butadiene rubber, or silicone rubber; or polyimide; polyamide-imide; polyurethane; polyethylene; or a mixture thereof. In this exemplary embodiment, the surface layer 64 is made of polyimide. The thickness of the surface layer 64 is larger than that of the base layer 62 and is, for example, 7.0 mm.

Because the base layer 62 and the surface layer 64 are made of these materials, the base layer 62 has a greater hardness than the surface layer 64. The base layer 62 has a lower volume resistivity than the surface layer 64.

As shown in FIG. 2, the length of the surface layer 64 in the circumferential direction is substantially the same as that of the transfer drum body 52, except for the recess 54. The length of the base layer 62 in the circumferential direction is larger than that of the surface layer 64.

As described above, although the inner circumferential surface of the surface layer 64 is bonded to the outer circumferential surface of the base layer 62 with an adhesive (bonding layer), the inner circumferential surface of the base layer 62 is not bonded to the outer circumferential surface of the transfer drum body 52. In other words, the base layer 62 is removably attached to the transfer drum body 52.

More specifically, as shown in FIGS. 2 to 4, one end of the base layer 62 in the circumferential direction is an extension portion 62A extending further in the circumferential direction than the surface layer 64. As shown in FIGS. 6 and 7, the end of the extension portion 62A has multiple bolt-insertion through-holes 62C and slits 62D formed alternately at predetermined intervals (equal intervals) in the axial direction of the transfer drum body 52. Instead of the slits 62D, through-holes (not shown) may be provided.

The slits 62D are formed in a substantially U shape in plan view, which is open at the end of the extension portion 62A, and have a width larger than or equal to the inside diameter of the through-holes 62C. The end of the extension portion 62A (i.e., the portion having the through-holes 62C and the slits 62D) is nipped between a pair of flat plate members 66 (66A and 66B), which are an example of moving members.

As shown in FIGS. 5 to 7, the flat plate members 66 extend in the axial direction of the transfer drum body 52. The flat plate member 66A has multiple bolt-insertion through-holes 66C and slits 66D formed alternately at predetermined intervals (equal intervals) in the axial direction (longitudinal direction) of the transfer drum body 52. Instead of the slits 66D, through-holes (not shown) may be provided.

The flat plate member 66B has multiple bolt-insertion slits 66E and penetrating female screw portions 66F formed alternately at predetermined intervals (equal intervals) in the axial direction (longitudinal direction) of the transfer drum body 52. Instead of the slits 66E, through-holes (not shown) may be provided.

The through-holes 66C and the female screw portions 66F have the same inside diameter, and the slits 66D and the slits 66E have the same width. The width of the slits 66D and 66E is larger than or equal to the inside diameter of the through-holes 66C.

Hence, the end of the extension portion 62A is attached to the pair of flat plate members 66 by nipping the end of the extension portion 62A between the flat plate members 66A and 66B, successively inserting shafts 86A (male screw portions) of flanged bolts (hereinbelow, simply "bolts") 86, which are an example of fastening members, through the through-holes 66C in the flat plate member 66A and the through-holes 62C in the extension portion 62A, and screwing the shafts 86A (male screw portions) into the female screw portions 66F in the flat plate member 66B.

The slits 62D provided at the end of the extension portion 62A correspond to the slits 66D and 66E, and slits 72A (described below). Thus, it is possible to insert shafts 84A of flanged bolts (hereinbelow, simply "bolts") 84, which are an example of fixing members described below, in the substantially circumferential direction of the transfer drum body 52, so that the bolts 84 can be easily attached even when the length of the shafts 84A thereof is larger than the length of the shafts 86A of bolts 86.

As shown in FIG. 6, the drum-side block 56 has multiple non-penetrating female screw portions 56A extending substantially in the radial direction, at predetermined intervals (equal intervals) in the axial direction of the transfer drum body 52. The extension portion 62A of the base layer 62 is attached to the drum-side block 56 via an adjusting mechanism 70 capable of adjusting tension in the circumferential direction.

Specifically, the adjusting mechanism 70 includes the flat plate members 66, multiple (for example, seven) bolts 84 provided in the axial direction of the transfer drum body 52, and the block member 72 extending in the axial direction of the transfer drum body 52 and bonded to the surface of the flat plate member 66B facing substantially radially inward (i.e., the surface opposite to the surface nipping the end of the extension portion 62A).

The bolts 84 are provided at equal intervals. The block member 72 has multiple through-holes 72B into which the ends of the shafts 86A of the bolts 86 to be screwed into the female screw portions 66F and project substantially radially inward are to be inserted. The block member 72 is also an example of the moving member that moves with the flat plate members 66.

The block member 72 has multiple bolt-insertion slits 72A formed at predetermined intervals (equal intervals, between the through-holes 72B) in the axial direction of the transfer drum body 52. Instead of the slits 72A, through-holes (not shown) may be provided. The block member 72 also has, at both ends thereof in the axial direction, the guide holes 74 into which guide pins 80 are to be inserted with a predetermined clearance.

Hence, the flat plate members 66 and the block member 72 are attached to the drum-side block 56 by inserting the guide pins 80 into the guide holes 74, inserting the shafts 84A of the bolts 84 into the slits 66D in the flat plate members 66A, the slits 62D in the extension portion 62A, the slits 66E in the flat plate member 66B, and the slits 72A in the block member 72 substantially in the circumferential direction, and screwing the shafts 84A (male screw portions) into the female screw portions 56A in the drum-side block 56.

The guide holes 74 are non-penetrating holes, and the depth thereof is set such that the ends of the guide pins 80 do not touch the bottoms of the guide holes 74 even when the tension in the base layer 62 is adjusted. Thus, it is possible to adjust the degree of screwing (amount of displacement) of the shafts 84A of the bolts 84 into the drum-side block 56 within a desired range, making it possible to adjust the tension in the base layer 62 in the circumferential direction with respect to the transfer drum body 52 to a predetermined value.

The depth of the guide holes 74 may be set such that the ends of the guide pins 80 touch the bottoms of the guide holes 74 when the tension in the base layer 62 is increased. This structure reduces the risk of excessively increasing the tension in the base layer 62 by mistake, when adjusting the tension.

Because there are multiple bolts 84 provided in the axial direction of the transfer drum body 52, the tension in the base layer 62 in the circumferential direction with respect to the transfer drum body 52 can be adjusted in accordance with the variation in the outside diameter of the transfer drum body 52 in the axial direction. The bolts 84 and 86 can be distinguished from each other by distinguishers, such as different colors painted on the heads thereof.

As shown in FIGS. 2 to 4, the other end of the base layer 62 in the circumferential direction is an extension portion 62B extending further in the circumferential direction than the surface layer 64. The end of the extension portion 62B has multiple bolt-insertion through-holes (not shown) provided at predetermined intervals (equal intervals) in the axial direction of the transfer drum body 52. The end of the extension portion 62B (the portion having the through-holes) is nipped between a pair of flat plate members 68 (68A and 68B).

The flat plate members 68 extend in the axial direction of the transfer drum body 52. The flat plate member 68A has multiple bolt-insertion through-holes (not shown) provided at predetermined intervals (equal intervals) in the axial direction (longitudinal direction) of the transfer drum body 52. The flat plate member 68B has multiple bolt-insertion through-holes (not shown) provided at predetermined intervals (equal intervals) in the axial direction (longitudinal direction) of the transfer drum body 52.

The drum-side block 58 has multiple non-penetrating female screw portions 58A (see FIG. 4) extending substantially in the radial direction, provided at predetermined intervals (equal intervals) in the axial direction of the transfer drum body 52. The through-holes in the flat plate member 68A, the through-holes in the flat plate member 68B, the through-holes in the extension portion 62B, and the female screw portions 58A in the drum-side block 58 all have the same inside diameter.

Thus, the end of the extension portion 62B is attached to the drum-side block 58 by nipping the end of the extension portion 62B between the flat plate members 68A and 68B, inserting the shafts 88A (male screw portions) of the flanged bolts (hereinbelow, simply "bolts") 88 through the through-holes in the flat plate member 68A, the through-holes in the extension portion 62B, and the through-holes in the flat plate member 68B in this order, and screwing the shafts 88A (male screw portions) into the female screw portions 58A in the drum-side block 58.

As described above, both ends of the base layer 62 in the circumferential direction are stored in the recess 54 in the transfer drum body 52 and are attached thereto by fastening the bolts. With this structure, the adjusting mechanism 70 does not inhibit the transportation of recording sheets P, and it is possible to change the transfer member 60 on the transfer drum body 52.

The operation (including the method for producing the transfer drum 50) of the thus-configured transfer drum 50 and the image forming apparatus 10 will be described.

As shown in FIG. 3, the drum-side blocks 56 and 58 are attached to the inside (the bottom surface 55 and the step portion 53) of the recess 54 in the transfer drum body 52 with the bolts 82. Then, the flat plate members 66 and 68 are attached to the ends of the extension portions 62A and 62B of the base layer 62 of the transfer member 60.

Specifically, the end of the extension portion 62B is nipped between the flat plate members 68, and the bolts 88 are inserted through the through-holes. The end of the extension portion 62A is nipped between the flat plate members 66 and is fastened with the bolts 86, and the bolts 84 are inserted through the slits 66D and 66E in the flat plate members 66 and the slits 72A in the block member 72. The transfer member 60 in this state is attached to the outer circumferential surface of the transfer drum body 52.

More specifically, the base layer 62 is disposed on the outer circumferential surface of the transfer drum body 52, and the bolts 88 provided at equal intervals are screwed into the female screw portions 58A in the drum-side block 58. Then, the guide pins 80 are inserted into the guide holes 74 to temporarily fix the flat plate members 66 and the block member 72 to the drum-side block 56. Then, the bolts 84 provided at equal intervals are screwed into the female screw portions 56A in the drum-side block 56.

Herein, when, for example, the bolt 84 at one end in the axial direction is fastened, because the guide pins 80 are inserted into the guide holes 74, the other ends of the flat plate members 66 and the block member 72 in the axial direction are positioned so as not to move substantially in the circumferential direction. Hence, when the transfer member 60 is wound on the transfer drum body 52 and is fixed thereto (i.e., when the flat plate members 66 and the block member 72 are fixed to the drum-side block 56), the temporary fixing position of the transfer member 60 (the flat plate members 66 and the block member 72) with respect to the transfer drum body 52 is stabilized, compared with the case where the temporary fixing position of the transfer member 60 with respect to the transfer drum body 52 is unfixed.

Herein the guide pins 80 are provided on the outer sides of the bolts 84 in the axial direction of the transfer drum body 52. In other words, in both directions of the axial direction, the guide pins 80 are provided closer to the ends of the transfer drum body 52 in the axial direction than the bolts 84. Thus, the operator does not need to hold the flat plate members 66 so as not to move substantially in the circumferential direction unlike the case where the guide pin 80 is provided only on one side in the axial direction of the transfer drum body 52. Thus, the efficiency in fixing the flat plate members 66 and the block member 72 with the bolts 84 is high.

When fastening the bolts 84, by adjusting the degree of screwing (amount of displacement) of the shafts 84A of the bolts 84 into the female screw portions 56A, the tension in the base layer 62 (transfer member 60) in the circumferential direction with respect to the transfer drum body 52 is adjusted to a predetermined value. More specifically, the base layer 62 is wound on the transfer drum body 52 with desired tensions according to the variation in the outside diameter of the transfer drum body 52 in the axial direction.

As described above, because the base layer 62 is stretched in the circumferential direction to generate tension, it is easy to generate tension, the maintainability is high, and the load on the surface layer 64, which is weak, is reduced. The positioning members formed of the guide pins 80 provided on the drum-side block 56 and the guide holes 74 provided in the block member 72 have a simple structure, compared with the case where, for example, positioning is performed by fastening bolts (not shown).

As shown in FIG. 3, the transfer member 60 may be distributed in a state in which the flat plate members 66 and 68 are attached thereto. This reduces the number of steps required to attach the transfer member 60 to the transfer drum body 52, compared with the case where the transfer member 60 is distributed in a state in which the flat plate members 66 and 68 are not attached to the transfer member 60.

Furthermore, the flat plate members 66 and the block member 72 are fixed to the drum-side block 56 (transfer drum body 52) with the bolts 84 extending substantially in the radial direction (depth direction of the recess 54). Hence, the flat plate members 66 and the block member 72 can be more easily fixed to the drum-side block 56 (transfer drum body 52) than in the case where the flat plate members 66 and the block member 72 are fixed to the drum-side block 56 (transfer drum body 52) with bolts (not shown) extending substantially in the circumferential direction of the transfer drum body 52.

The extension portion 62A of the base layer 62 (transfer member 60) is fastened to and held by the flat plate members 66 with the multiple bolts 86 provided in the axial direction, and the bolts 84 except for those at both ends in the axial direction are provided between the bolts 86 (the bolts 86 are provided between the bolts 84). Hence, the flat plate members 66, together with the block member 72, are stably fixed in the axial direction of the transfer drum body 52, compared with the case where the bolts 84 fix only the ends of the flat plate members 66 holding the extension portion 62A of the base layer 62.

Although the bolts 86 extending substantially in the radial direction (depth direction of the recess 54) overlap the bolts 84 as viewed in the axial direction of the transfer drum body 52, the bolts 84 and 86 can be distinguished from each other by distinguishers. This prevents an operator from turning the bolts 86 and removing the extension portion 62A from the flat plate members 66 by mistake when the bolts 84 are to be turned to remove the flat plate members 66 and the block member 72 from the drum-side block 56 to replace the transfer member 60.

Furthermore, the drum-side block 56 attached to the transfer drum body 52 is replaceable. Hence, when the female screw portions 56A screwed with the bolts 84 deteriorate with time, the drum-side block 56 can be replaced, saving the cost compared with the case where the transfer drum body 52 is replaced. The drum-side block 58 is also replaceable.

Furthermore, the extension portions 62A and 62B of the base layer 62 extend further in the circumferential direction than the ends of the surface layer 64 in the circumferential direction such that predetermined lengths thereof are stored in the recess 54. This makes it easy to attach the transfer member 60 to the transfer drum body 52, compared with the case where both ends of the base layer 62 in the circumferential direction do not extend further in the circumferential direction than the ends of the surface layer 64 in the circumferential direction, and thus, ease of attaching/detaching of the base layer 62 to/from the transfer drum body 52 (efficiency in changing the transfer member 60) is high.

The base layer 62 is wound on the transfer drum body 52 with the surface layer 64 being bonded thereto. Hence, compared with the case where the surface layer 64 is not bonded to the base layer 62, in other words, the case where the base layer 62 is wound on the transfer drum body 52, and then the surface layer 64 is wound on the base layer 62 without being bonded thereto, ease of attaching/detaching of the base layer 62 and the surface layer 64 to/from the transfer drum body 52 (efficiency in changing the transfer member 60) is high.

The thus-produced transfer drum 50 is assembled into the image forming apparatus 10. A recording sheet P fed out of the storage unit 14 is transported to the transfer drum 50 by the first transport unit 44. The transfer drum 50 is rotationally driven in the direction of arrow B in FIG. 1, and, while gripping the downstream end of a recording sheet P transported by the first transport unit 44 with the grippers, transports the recording sheet P to the second transfer position T2 (nip area Np), where a toner image is transferred from the transfer belt 42 to the recording sheet P.

More specifically, when a toner image is transferred from the transfer belt 42 to the recording sheet P, the recording sheet P passes through the nip area Np while being nipped between the surface layer 64 of the transfer drum 50 and the outer circumferential surface of the transfer belt 42 with a predetermined pressure. Hence, in the nip area Np, the surface layer 64 of the transfer member 60 on the transfer drum 50 rotates while being pressed (elastically deformed) by the backup roller 38 with the transfer belt 42 therebetween. Hence, the occurrence of image defects is reduced, compared with the case where a toner image is transferred by a transfer drum 50 on which the transfer member 60 is wound and fixed without the temporary fixing position thereof being stabilized (fixed).

Modification

Figure 8:
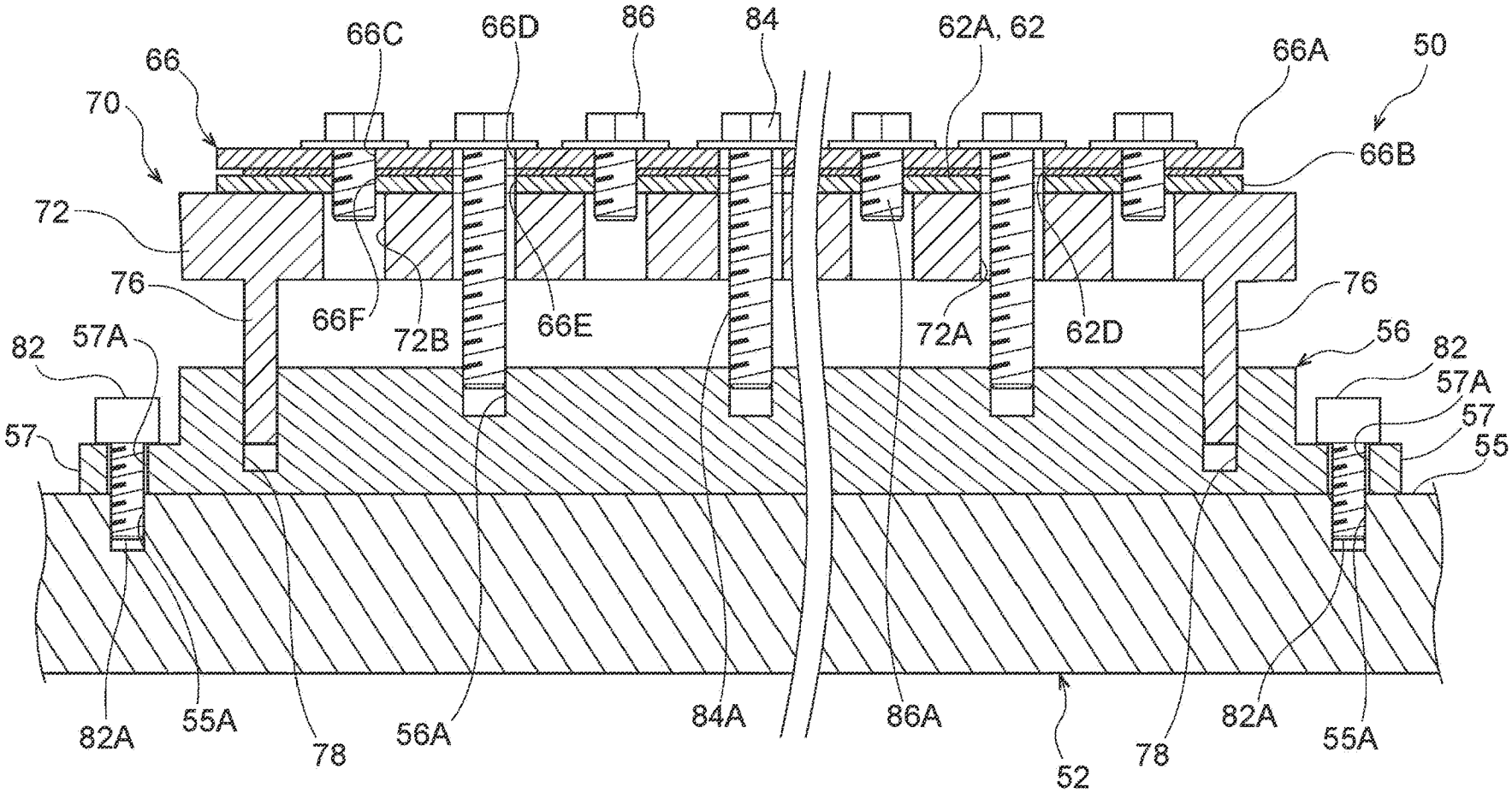
FIG. 8 is a sectional view showing the configuration of the recess in the transfer drum according to a first modification of the exemplary embodiment, as viewed in the circumferential direction.

As in a first modification shown in FIG. 8, the block member 72 may have cylindrical guide pins 76, and the drum-side block 56 may have non-penetrating guide holes 78 into which the guide pins 76 can be inserted. As in a second modification shown in FIGS. 9A and 9B, the block member 72 alone may be attached to the drum-side block 56 with the bolts 84.

More specifically, the flat plate members 66A and 66B do not have the slits 66D and 66E, and the block member 72 has multiple through-holes 72C (or slits) extending in the direction perpendicular to the axial direction of the bolts 86 for attaching the extension portion 62A of the base layer 62 to the flat plate members 66. The bolts 84 are inserted through the through-holes 72C and screwed into the female screw portions 56A in the drum-side block 56.

In this case, the extension portion 62A of the base layer 62 can be attached to the block member 72 without being bent at 90 degrees in the substantially circumferential direction, as shown in FIG. 4. With this configuration, the outer sides of the bolts 86 in the substantially radial direction are covered with the base layer 62.

Figure 9A:
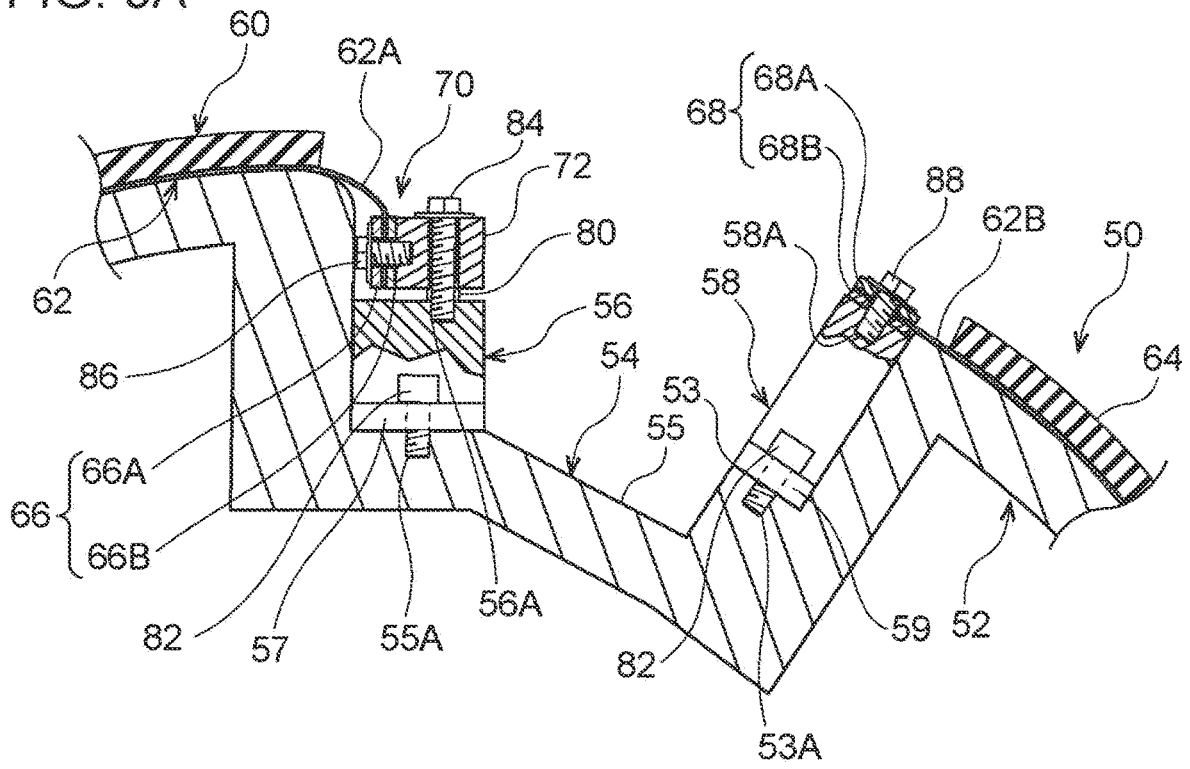
FIGS. 9A and 9B are an enlarged side view and a sectional view as viewed in the circumferential direction, respectively, showing the configuration of the recess in the transfer drum according to a second modification of the exemplary embodiment.
Figure 9B:
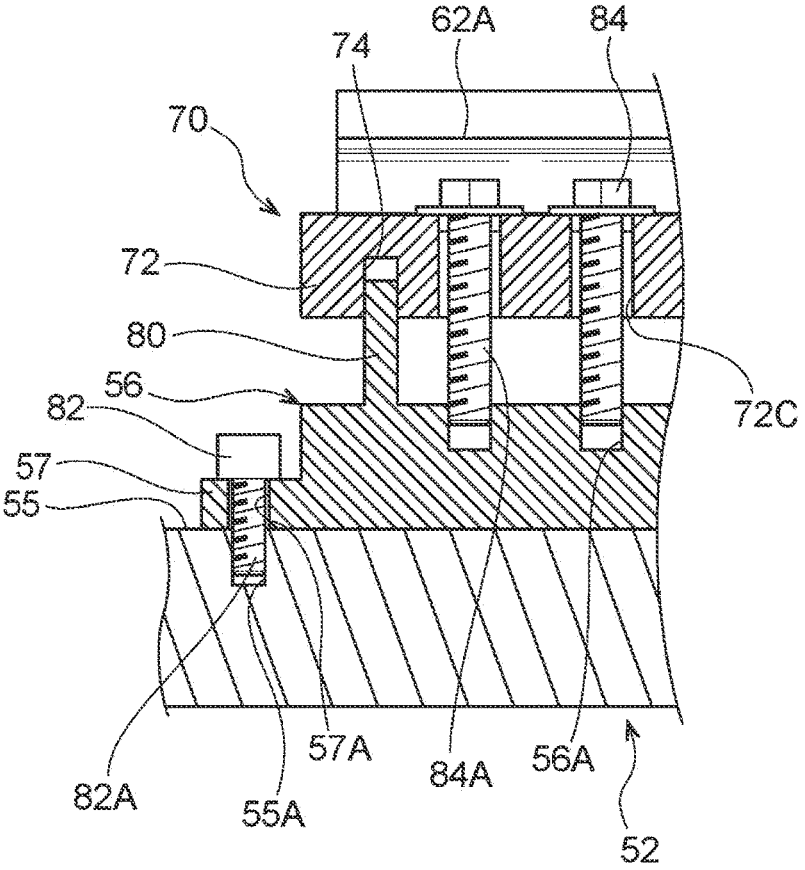

Hence, it is possible to reduce the risk of displacing the bolts 86 instead of the bolts 84 by mistake when the tension in the base layer 62 is adjusted. As shown in FIG. 9A, the height of the drum-side block 58 in the substantially radial direction may be increased to a position near the outer circumferential surface of the transfer drum body 52, so that the extension portion 62B of the base layer 62 can be attached thereto without being bent.

The transfer drum 50 (drum member) and the image forming apparatus 10 according to this exemplary embodiment are not limited to those illustrated in the drawings, but may be appropriately modified within the scope of the present disclosure. For example, the transfer drum body 52 does not need to be substantially cylindrical, but may be substantially columnar.

Furthermore, a configuration only with the base layer 62 and without the surface layer 64 is possible. Specifically, the base layer 62 does not need to be a metal layer made of a metal material, such as stainless steel, and the base layer 62 may be, for example, a resin layer made of conductive resin material, such as solid rubber, polyimide, polyamide-imide, polyurethane, polyethylene, polycarbonate, polyethylene terephthalate, or a mixture thereof.

Although the surface layer 64 is bonded to the base layer 62 with an adhesive (bonding layer), the method of bonding the surface layer 64 to the base layer 62 is not limited thereto. For example, the inner circumferential surface of the surface layer 64 to be in contact with the outer circumferential surface of the base layer 62 may be fused by heat and bonded to the outer circumferential surface of the base layer 62. The transfer member 60 may have a cover layer (not shown) on the outer circumferential surface of the surface layer 64. The cover layer does not need to be a single layer, but may include multiple layers.

The guide pins 80 may be formed as a part of the drum-side block 56 or may be formed separately and joined to the drum-side block 56 by, for example, being pressed into holes (not shown). There need to be at least one guide pin 76 and one guide pin 80 at each end in the axial direction. The guide pins 76 and 80 do not need to be cylindrical, but may be, for example, polygonal columnar.

Furthermore, it is possible to provide the guide pins 76 on the inward-facing surface of the flat plate member 68B in the substantially radial direction and provide the guide holes 78, into which the guide pins 76 can be inserted, in the drum-side block 58 to enable positioning. The guide holes 74 and 78 may be penetrating holes (not shown). The distinguishers for distinguishing the bolts 84 and 86 from each other are not limited to different colors painted on the heads thereof.

The flat plate members 66 and the block member 72 may be directly attached to the bottom surface 55 of the transfer drum body 52, without providing the drum-side block 56. Similarly, the flat plate members 68 may be directly attached to the step portion 53 of the transfer drum body 52, without providing the drum-side block 58. In this exemplary embodiment, fixing with the bolts 84 and 88 means both fixing to the transfer drum body 52 with the drum-side blocks 56 and 58 and direct fixing to the transfer drum body 52 without the drum-side blocks 56 and 58.

Although the extension portion 62B of the base layer 62 is fixed to the transfer drum body 52 (drum-side block 58), and the extension portion 62A of the base layer 62 is attached to the transfer drum body 52 (drum-side block 56) via the adjusting mechanism 70, the configuration is not limited thereto. For example, both of the extension portions 62A and 62B of the base layer 62 may be attached to the transfer drum body 52 via the adjusting mechanisms 70.

Although the extension portion 62A of the base layer 62 is nipped between the pair of flat plate members 66, and the extension portion 62B of the base layer 62 is nipped between the pair of flat plate members 68, the configuration is not limited thereto. For example, the extension portion 62A may be attached only to the flat plate member 66B, and the extension portion 62B may be attached only to the flat plate member 68B.

Besides the transfer drum 50, the drum member may be applied to, for example, a fixing drum for fixing toner with pressure, or a blanket drum used in offset printing. Although a toner image formed with a dry electrophotographic system has been described as an example of the image in this exemplary embodiment, the configuration is not limited thereto. For example, this exemplary embodiment may be applied to a toner image formed with a wet electrophotographic system or an image formed by an ink jet method.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A drum member comprising:

a substantially cylindrical drum body having a hollow part extending in an axial direction;

a sheet member wound on the drum body;

an adjusting mechanism configured to adjust tension in the sheet member, the adjusting mechanism including a moving member that holds an end of the sheet member in a circumferential direction and moves in a depth direction of the hollow part, and a fixing member that fixes the moving member to the drum body; and one or more positioning members that position the moving member such that the moving member does not move in the circumferential direction of the drum body when the moving member is fixed with the fixing member.

2. The drum member according to claim 1, wherein the moving member is fixed to the drum body with the fixing member extending in the depth direction.

3. The drum member according to claim 2, wherein the sheet member is fastened to the moving member by a plurality of fastening members arranged along the axial direction and held by the moving member, and the fixing member is provided between the fastening members.

4. The drum member according to claim 3, wherein the fastening members extend in the depth direction and overlap the fixing member as viewed in the axial direction, and the fixing member and the fastening members are distinguishable from each other.

5. The drum member according to claim 4, wherein the one or more positioning members are provided on outer sides of the fixing member in the axial direction.

6. The drum member according to claim 5, wherein the drum body has a replaceable seating member in the hollow part, and the moving member is fixed to the seating member with the fixing member.

7. The drum member according to claim 6, wherein the one or more positioning members each include a guide pin that is provided on one of the moving member and the seating member and extends in the depth direction, and a guide hole that is provided in the other of the moving member and the seating member and into which the guide pin is inserted.

8. The drum member according to claim 4, wherein the drum body has a replaceable seating member in the hollow part, and the moving member is fixed to the seating member with the fixing member.

9. The drum member according to claim 8, wherein the one or more positioning members each include a guide pin that is provided on one of the moving member and the seating member and extends in the depth direction, and a guide hole that is provided in the other of the moving member and the seating member and into which the guide pin is inserted.

10. The drum member according to claim 3, wherein the one or more positioning members are provided on outer sides of the fixing member in the axial direction.

11. The drum member according to claim 10, wherein the drum body has a replaceable seating member in the hollow part, and the moving member is fixed to the seating member with the fixing member.

12. The drum member according to claim 11, wherein the one or more positioning members each include a guide pin that is provided on one of the moving member and the seating member and extends in the depth direction, and a guide hole that is provided in the other of the moving member and the seating member and into which the guide pin is inserted.

13. The drum member according to claim 3, wherein the drum body has a replaceable seating member in the hollow part, and the moving member is fixed to the seating member with the fixing member.

14. The drum member according to claim 13, wherein the one or more positioning members each include a guide pin that is provided on one of the moving member and the seating member and extends in the depth direction, and a guide hole that is provided in the other of the moving member and the seating member and into which the guide pin is inserted.

15. The drum member according to claim 2, wherein the drum body has a replaceable seating member in the hollow part, and the moving member is fixed to the seating member with the fixing member.

16. The drum member according to claim 15, wherein the one or more positioning members each include a guide pin that is provided on one of the moving member and the seating member and extends in the depth direction, and a guide hole that is provided in the other of the moving member and the seating member and into which the guide pin is inserted.

17. The drum member according to claim 1, wherein the drum body has a replaceable seating member in the hollow part, and the moving member is fixed to the seating member with the fixing member.

18. The drum member according to claim 17, wherein the one or more positioning members each include a guide pin that is provided on one of the moving member and the seating member and extends in the depth direction, and a guide hole that is provided in the other of the moving member and the seating member and into which the guide pin is inserted.

19. The drum member according to claim 1, wherein the sheet member includes an inner layer to be in contact with the drum body, and an outer layer disposed on the inner layer, and the inner layer is a metal layer, the outer layer is a non-metal layer, and the metal layer is stretched in the circumferential direction to generate tension.

20. An image forming apparatus comprising:

the drum member according to claim 1, the drum member transporting a recording medium; and an intermediate transfer device that transfers a toner image to the recording medium transported by the drum member.

* * * * *